US011419475B2

(12) United States Patent
Durham

(10) Patent No.: US 11,419,475 B2
(45) Date of Patent: Aug. 23, 2022

(54) DISHWASHING APPLIANCES AND METHODS FOR ADDRESSING OBSTRUCTION THEREIN

(71) Applicant: Haier US Appliance Solutions, Inc., Wilmington, DE (US)

(72) Inventor: Kyle Edward Durham, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 218 days.

(21) Appl. No.: 16/690,997

(22) Filed: Nov. 21, 2019

(65) Prior Publication Data

US 2021/0153713 A1 May 27, 2021

(51) Int. Cl.
*A47L 15/00* (2006.01)
*A47L 15/42* (2006.01)

(52) U.S. Cl.
CPC ..... *A47L 15/0049* (2013.01); *A47L 15/0031* (2013.01); *A47L 15/0039* (2013.01); *A47L 15/4208* (2013.01); *A47L 15/4223* (2013.01)

(58) Field of Classification Search
CPC ..... A47L 15/0031; A47L 15/0039; A47L 15/0049; A47L 15/4208; A47L 15/4223; A47L 2401/14; A47L 2501/02; A47L 2501/04
See application file for complete search history.

(56) References Cited

U.S. PATENT DOCUMENTS

| | | | | |
|---|---|---|---|---|
| 5,909,743 | A * | 6/1999 | Thies | A47L 15/4204 134/10 |
| 8,702,874 | B2 * | 4/2014 | Montgomery | A47L 15/0049 134/56 D |
| 9,192,280 | B2 | 11/2015 | Montgomery et al. | |
| 9,565,987 | B2 * | 2/2017 | Poyner | G05B 15/02 |
| 9,872,597 | B2 | 1/2018 | Pers et al. | |
| 10,244,919 | B2 * | 4/2019 | Pers | A47L 15/4244 |
| 11,141,039 | B2 * | 10/2021 | Persson | A47L 15/0023 |
| 2006/0130878 | A1 * | 6/2006 | Lee | A47L 15/4225 134/18 |

(Continued)

FOREIGN PATENT DOCUMENTS

| | | |
|---|---|---|
| CN | 103120576 B | 9/2015 |
| DE | 10246017 A1 | 4/2004 |

*Primary Examiner* — Duy Vu N Deo
*Assistant Examiner* — Christopher Remavege
(74) *Attorney, Agent, or Firm* — Dority & Manning, P.A.

(57) ABSTRACT

Dishwashing appliances and methods, as provided herein, may include features or steps such as measuring an initial pressure in a sump with a pressure sensor, activating a drain pump when the measured initial pressure in the sump is greater than or equal to a first pressure threshold, and starting a timer when the drain pump is activated. Dishwashing appliances and methods may further include features or steps for monitoring pressure within the sump with the pressure sensor after activating the drain pump, recording a value of the timer as a first time when the monitored pressure reaches a second pressure threshold, calculating a time limit based on the recorded first time value, and determining that the filter is clogged when the monitored pressure does not reach a third pressure threshold before the time limit expires.

18 Claims, 5 Drawing Sheets

(56) References Cited

U.S. PATENT DOCUMENTS

| | | | | |
|---|---|---|---|---|
| 2006/0237052 | A1* | 10/2006 | Picardat | A47L 15/4221 134/56 D |
| 2009/0000671 | A1 | 1/2009 | Montagnana | |
| 2013/0008477 | A1 | 1/2013 | Forst et al. | |
| 2018/0310798 | A1* | 11/2018 | Persson | A47L 15/0023 |
| 2019/0159652 | A1 | 5/2019 | Durham | |

* cited by examiner

DISHWASHING APPLIANCES AND METHODS FOR ADDRESSING OBSTRUCTION THEREIN

FIELD OF THE INVENTION

The present subject matter relates generally to dishwashing appliances, and more particularly to features and methods for addressing obstructions or clogs in a dishwashing appliance.

BACKGROUND OF THE INVENTION

Dishwashing appliances generally include a tub that defines a wash chamber. Rack assemblies can be mounted within the wash chamber of the tub for receipt of articles for washing. Multiple spray assemblies can be positioned within the wash chamber for applying or directing wash liquid (e.g., water, detergent, etc.) towards articles disposed within the rack assemblies in order to clean such articles. Dishwashing appliances are also typically equipped with one or more pumps, such as a circulation pump or a drain pump, for directing or motivating wash liquid from the wash chamber to, e.g., the spray assemblies or an area outside of the dishwashing appliance.

Conventional dishwashing appliances include one or more filter assemblies for filtering the wash liquid exiting the wash chamber. Depending upon the level of soil upon the articles, fluids used during wash and rinse cycles will become contaminated with sediment (e.g., soil, food particles, etc.) in the form of debris or particles that are carried with the liquid. In order to protect the pump, it is beneficial to filter the liquid so that sediment and materials are removed or reduced from the liquid supplied to the pump. As a result, a filter assembly may be provided within or below a sump portion of the tub.

Over time and after repeated use of a dishwashing appliance, sediment may accumulate within a filter assembly. If left unaddressed, the accumulation may lead to obstructions or clogs in the sump, pump, or another portion of a liquid flow path. This may produce undesirable noises, impair appliance performance, and may even damage the dishwashing appliance. It may be useful for a filter assembly to be regularly cleaned, but this can be difficult for a user. Often, users are unaware of the recommended cleaning schedule for the filter assembly. Moreover, even if a recommended schedule for cleaning is known, a particular dishwasher may deviate from the schedule. In other words, the filter assembly may become dirty faster or slower than predicted by the schedule.

Accordingly, dishwashing appliances that include features for addressing or monitoring obstructions within a filter assembly and methods therefor that address one or more of the challenges noted above would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a dishwashing appliance is provided. The dishwashing appliance includes a sump, a pressure sensor mounted within the sump, a filter downstream from the pressure sensor, and a drain pump downstream from the pressure sensor. The method includes measuring an initial pressure in the sump with the pressure sensor and activating the drain pump when the measured initial pressure in the sump is greater than or equal to a first pressure threshold. The method also includes starting a timer when the drain pump is activated, monitoring pressure within the sump with the pressure sensor after activating the drain pump, and recording a value of the timer as a first time when the monitored pressure reaches a second pressure threshold. The method further includes calculating a time limit based on the recorded first time value. When the monitored pressure does not reach a third pressure threshold before the time limit expires, it is determined that the filter is clogged.

In another exemplary aspect of the present disclosure, a dishwashing appliance is provided. The dishwashing appliance includes a cabinet and a tub positioned within the cabinet. The tube defines a wash chamber for receipt of articles for washing. The dishwashing appliance also includes a spray assembly positioned within the wash chamber, a sump positioned at a bottom of the wash chamber, a drain pump in fluid communication with the sump, a pressure sensor upstream of the drain pump, a filter downstream from the pressure sensor, and a controller. The controller is in operative communication with the pressure sensor and the drain pump. The controller is configured for measuring an initial pressure in the sump with the pressure sensor and activating the drain pump when the measured initial pressure in the sump is greater than or equal to a first pressure threshold. The controller is also configured for starting a timer when the drain pump is activated, monitoring pressure within the sump with the pressure sensor after activating the drain pump, and recording a value of the timer as a first time when the monitored pressure reaches a second pressure threshold. The controller is further configured for calculating a time limit based on the recorded first time value. When the monitored pressure does not reach a third pressure threshold before the time limit expires, the controller determines that the filter is clogged.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
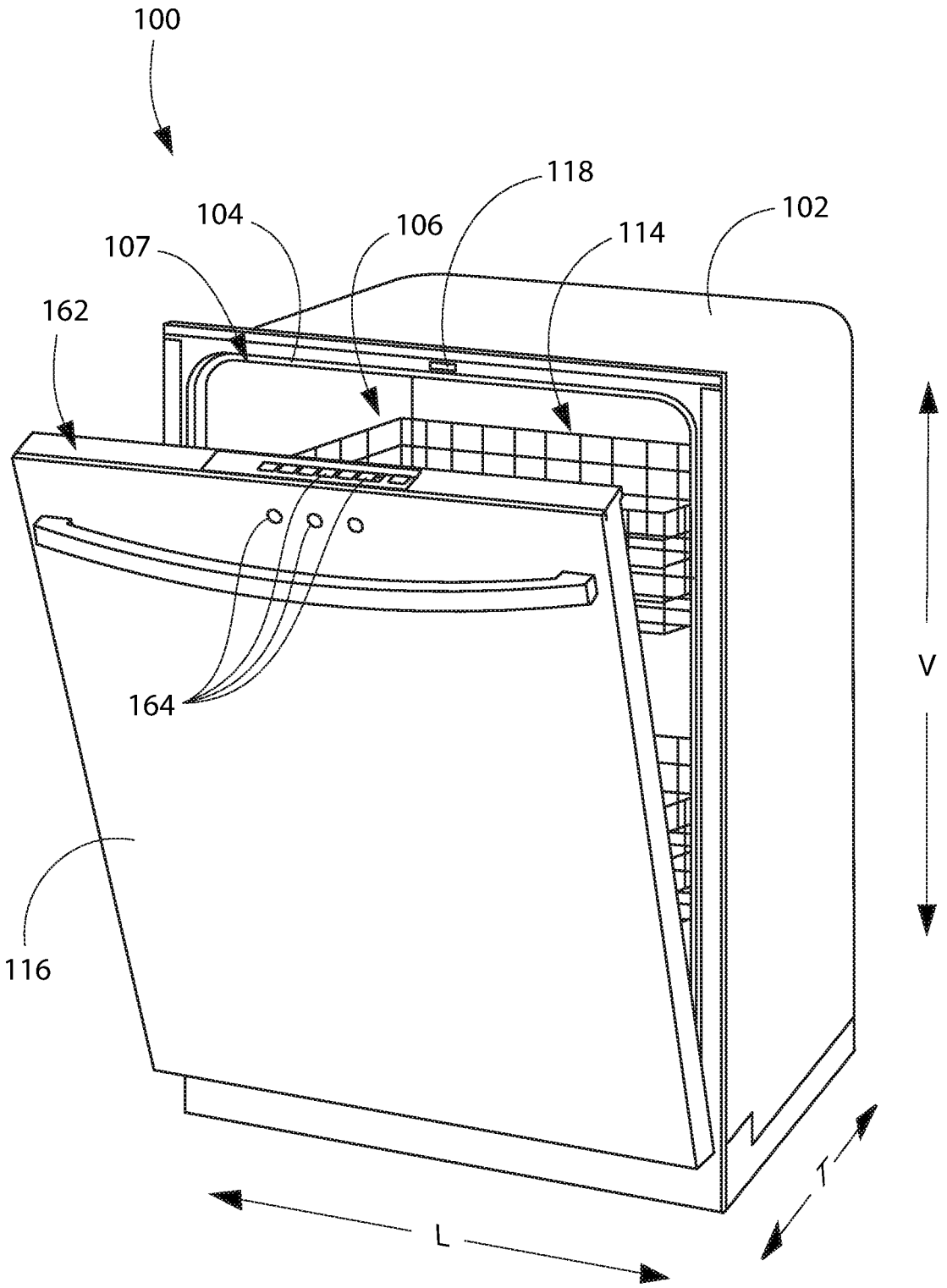
FIG. 1 provides a perspective view of an exemplary embodiment of a dishwashing appliance of the present disclosure with a door in a partially open position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For instance, "upstream" refers to the flow direction from which the fluid flows, and "downstream" refers to the flow direction to which the fluid flows. The term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a wash liquid (e.g., water, detergent, or wash additive). The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash liquid" refers to a liquid used for washing or rinsing the articles that is typically made up of water and may include additives, such as detergent or other treatments (e.g., rinse aid). Furthermore, as used herein, terms of approximation, such as "approximately," "substantially," or "about," refer to being within a ten percent (10%) margin of error.

Figure 2:
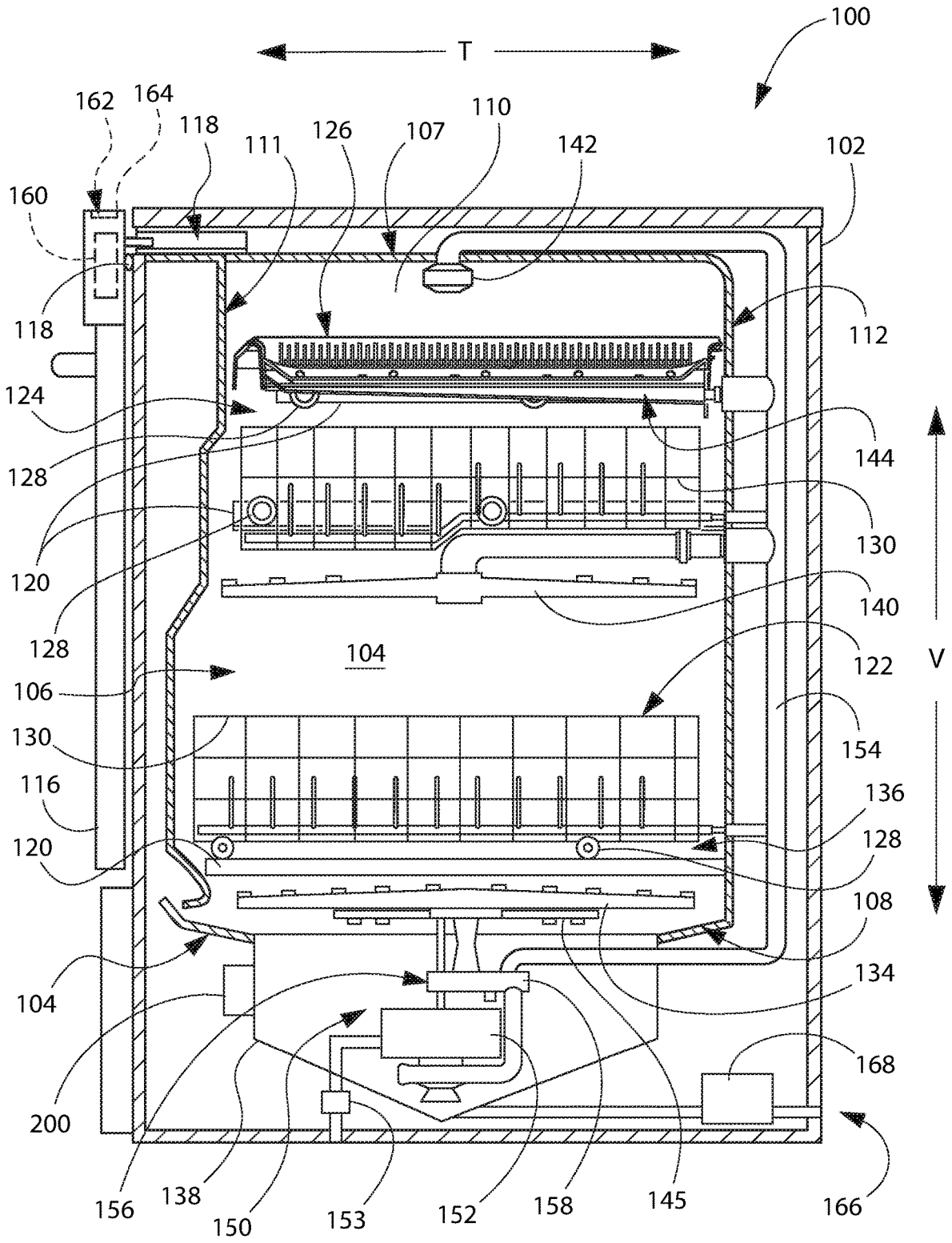
FIG. 2 provides a side, cross sectional view of the exemplary dishwashing appliance of FIG. 1.

Turning now to the figures, FIGS. 1 and 2 depict an exemplary dishwasher or dishwashing appliance (e.g., dishwashing appliance 100) that may be configured in accordance with aspects of the present disclosure. Generally, dishwasher 100 defines a vertical direction V, a lateral direction L, and a transverse direction T. Each of the vertical direction V, lateral direction L, and transverse direction T are mutually perpendicular to one another and form an orthogonal direction system.

Dishwasher 100 includes a cabinet 102 having a tub 104 therein that defines a wash chamber 106. As shown in FIG. 2, tub 104 extends between a top 107 and a bottom 108 along the vertical direction V, between a pair of side walls 110 along the lateral direction L, and between a front side 111 and a rear side 112 along the transverse direction T.

Tub 104 includes a front opening 114. In some embodiments, the dishwasher appliance 100 may also include a door 116 at the front opening 114. The door 116 may, for example, be hinged at its bottom for movement between a normally closed vertical position, wherein the wash chamber 106 is sealed shut for washing operation, and a horizontal open position for loading and unloading of articles from dishwasher 100. A door closure mechanism or assembly 118 may be provided to lock and unlock door 116 for accessing and sealing wash chamber 106.

In exemplary embodiments, tub side walls 110 accommodate a plurality of rack assemblies. For instance, guide rails 120 may be mounted to side walls 110 for supporting a lower rack assembly 122, a middle rack assembly 124, or an upper rack assembly 126. In some such embodiments, upper rack assembly 126 is positioned at a top portion of wash chamber 106 above middle rack assembly 124, which is positioned above lower rack assembly 122 along the vertical direction V.

Generally, each rack assembly 122, 124, 126 may be adapted for movement between an extended loading position (not shown) in which the rack is substantially positioned outside the wash chamber 106, and a retracted position (shown in FIGS. 1 and 2) in which the rack is located inside the wash chamber 106. In some embodiments, movement is facilitated, for instance, by rollers 128 mounted onto rack assemblies 122, 124, 126, respectively.

Although guide rails 120 and rollers 128 are illustrated herein as facilitating movement of the respective rack assemblies 122, 124, 126, it should be appreciated that any suitable sliding mechanism or member may be used according to alternative embodiments.

In optional embodiments, some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash liquid to reach and impinge on those articles (e.g., during a cleaning or rinsing cycle). According to additional or alternative embodiments, a silverware basket (not shown) is removably attached to a rack assembly (e.g., lower rack assembly 122), for placement of silverware, utensils, and the like, that are otherwise too small to be accommodated by the rack assembly.

Generally, dishwasher 100 includes one or more spray assemblies for urging a flow of fluid (e.g., wash liquid) onto the articles placed within wash chamber 106.

In exemplary embodiments, dishwasher 100 includes a lower spray arm assembly 134 disposed in a lower region 136 of wash chamber 106 and above a sump 138 so as to rotate in relatively close proximity to lower rack assembly 122.

In additional or alternative embodiments, a mid-level spray arm assembly 140 is located in an upper region of wash chamber 106 (e.g., below and in close proximity to middle rack assembly 124). In this regard, mid-level spray arm assembly 140 may generally be configured for urging a flow of wash liquid up through middle rack assembly 124 and upper rack assembly 126.

In further additional or alternative embodiments, an upper spray assembly 142 is located above upper rack assembly 126 along the vertical direction V. In this manner, upper spray assembly 142 may be generally configured for urging or cascading a flow of wash liquid downward over rack assemblies 122, 124, and 126.

In yet further additional or alternative embodiments, upper rack assembly 126 may further define an integral spray manifold 144. As illustrated, integral spray manifold 144 may be directed upward, and thus generally configured for urging a flow of wash liquid substantially upward along the vertical direction V through upper rack assembly 126.

In still further additional or alternative embodiments, a filter clean spray assembly 145 is disposed in a lower region 136 of wash chamber 106 (e.g., below lower spray arm assembly 134) and above a sump 138 so as to rotate in relatively close proximity to a filter assembly 210. For instance, filter clean spray assembly 145 may be directed downward to urge a flow of wash liquid across a portion of filter assembly 210 (FIG. 3) or sump 138.

The various spray assemblies and manifolds described herein may be part of a fluid distribution system or fluid circulation assembly 150 for circulating wash liquid in tub 104. In certain embodiments, fluid circulation assembly 150 includes a circulation pump 152 for circulating wash liquid in tub 104. Circulation pump 152 may be located within sump 138 or within a machinery compartment located below sump 138 of tub 104.

When assembled, circulation pump 152 may be in fluid communication with an external water supply line (not shown) and sump 138. A water inlet valve 153 can be positioned between the external water supply line and circulation pump 152 (e.g., to selectively allow water to flow from the external water supply line to circulation pump 152). Additionally or alternatively, water inlet valve 153 can be positioned between the external water supply line and sump 138 (e.g., to selectively allow water to flow from the external water supply line to sump 138). During use, water inlet valve 153 may be selectively controlled to open to allow the flow of water into dishwasher 100 and may be selectively controlled to cease the flow of water into dishwasher 100. Further, fluid circulation assembly 150 may include one or more fluid conduits or circulation piping for directing wash fluid from circulation pump 152 to the various spray assemblies and manifolds. In exemplary embodiments, such as that shown in FIG. 2, a primary supply conduit 154 extends from circulation pump 152, along rear 112 of tub 104 along the vertical direction V to supply wash liquid throughout wash chamber 106.

In some embodiments, primary supply conduit 154 is used to supply wash liquid to one or more spray assemblies (e.g., to mid-level spray arm assembly 140 or upper spray assembly 142). It should be appreciated, however, that according to alternative embodiments, any other suitable plumbing configuration may be used to supply wash liquid throughout the various spray manifolds and assemblies described herein. For instance, according to another exemplary embodiment, primary supply conduit 154 could be used to provide wash liquid to mid-level spray arm assembly 140 and a dedicated secondary supply conduit (not shown) could be utilized to provide wash liquid to upper spray assembly 142. Other plumbing configurations may be used for providing wash liquid to the various spray devices and manifolds at any location within dishwashing appliance 100.

Each spray arm assembly 134, 140, 142, integral spray manifold 144, filter clean assembly 145, or other spray device may include an arrangement of discharge ports or orifices for directing wash liquid received from circulation pump 152 onto dishes or other articles located in wash chamber 106. The arrangement of the discharge ports, also referred to as jets, apertures, or orifices, may provide a rotational force by virtue of wash liquid flowing through the discharge ports. Alternatively, spray assemblies 134, 140, 142, 145 may be motor-driven, or may operate using any other suitable drive mechanism. Spray manifolds and assemblies may also be stationary. The resultant movement of the spray assemblies 134, 140, 142, 145 and the spray from fixed manifolds provides coverage of dishes and other dishwasher contents with a washing spray. Other configurations of spray assemblies may be used as well. For instance, dishwasher 100 may have additional spray assemblies for cleaning silverware, for scouring casserole dishes, for spraying pots and pans, for cleaning bottles, etc.

In optional embodiments, circulation pump 152 urges or pumps wash liquid (e.g., from filter assembly 210) to a diverter 156 (FIG. 2). In some such embodiments, diverter 156 is positioned within sump 138 of dishwashing appliance 100). Diverter 156 may include a diverter disk (not shown) disposed within a diverter chamber 158 for selectively distributing the wash liquid to the spray assemblies 134, 140, 142, or other spray manifolds. For instance, the diverter disk may have a plurality of apertures that are configured to align with one or more outlet ports (not shown) at the top of diverter chamber 158. In this manner, the diverter disk may be selectively rotated to provide wash liquid to the desired spray device.

In exemplary embodiments, diverter 156 is configured for selectively distributing the flow of wash liquid from circulation pump 152 to various fluid supply conduits—only some of which are illustrated in FIG. 2 for clarity. In certain embodiments, diverter 156 includes four outlet ports (not shown) for supplying wash liquid to a first conduit for rotating lower spray arm assembly 134, a second conduit for supplying wash liquid to filter clean assembly 145, a third conduit for spraying an auxiliary rack such as the silverware rack, and a fourth conduit for supply mid-level or upper spray assemblies 140, 142 (e.g., primary supply conduit 154).

In some embodiments, an exemplary filter assembly 210 (FIG. 3) is provided. As illustrated for example in FIG. 3, in exemplary embodiments, filter assembly 210 is located in the sump 138, e.g., to filter fluid to circulation assembly 150 and/or drain pump 168. Generally, filter assembly 210 removes soiled particles from the liquid that flows to the sump 138 from the wash chamber 106 during operation of dishwashing appliance 100. In exemplary embodiments, filter assembly 210 includes both a first filter 212 (also referred to as a "coarse filter") and a second filter 214 (also referred to as a "fine filter").

In some embodiments, the first filter 212 is constructed as a grate having openings for filtering liquid received from wash chamber 106. The sump 138 includes a recessed portion upstream of circulation pump 152 or drain pump 168 and over which the first filter 212 is removably received. In exemplary embodiments, the first filter 212 may be a coarse filter having media openings in the range of about 0.030 inches to about 0.060 inches. The recessed portion may define a filtered volume wherein debris or particles have been filtered from the wash liquid by the first filter 212 or the second filter 214.

In additional or alternative embodiments, the second filter 214 is provided upstream of circulation pump 152 or drain pump 168. Second filter 214 may be non-removable or, alternatively, may be provided as a removable cartridge positioned in a tub receptacle 216 (FIG. 3) formed in sump 138.

Figure 3:
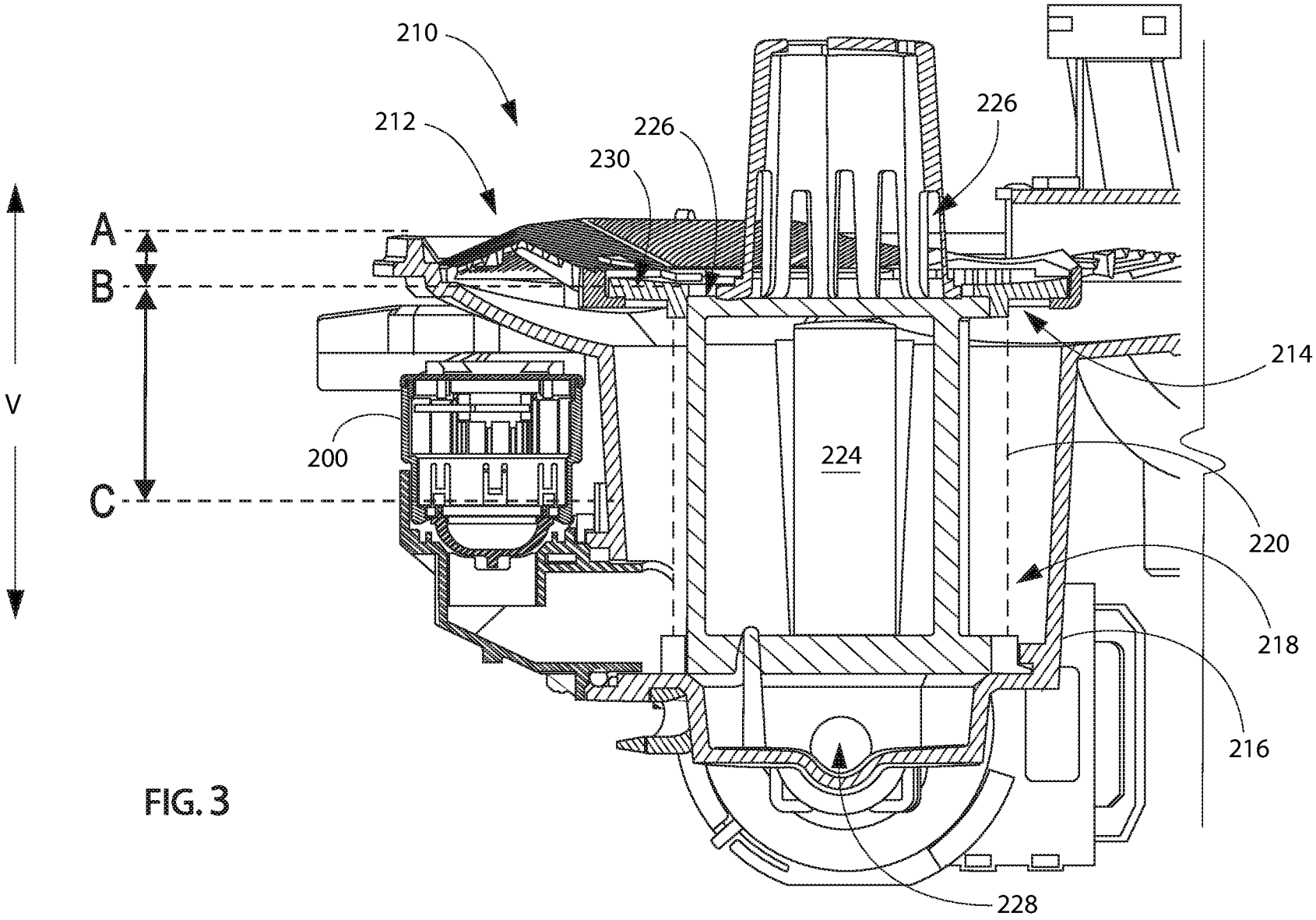
FIG. 3 provides a close up, cross sectional view of a sump and a pressure sensor of the dishwashing appliance of FIGS. 1 and 2.

For instance, as illustrated in FIG. 3, the second filter 214 may be removably positioned within a collection chamber 218 defined by tub receptacle 216. The second filter 214 may be generally shaped to complement the tub receptacle 216. For instance, the second filter 214 may include a filter wall 220 that complements the shape of the tub receptacle 216. In some embodiments, the filter wall 220 is formed from one or more fine filter media. Some such embodiments may include filter media (e.g., screen or mesh, having pore or hole sizes in the range of about 50 microns to about 600 microns).

When assembled, the filter wall 220 may have an enclosed (e.g., cylindrical) shape defining an internal chamber 224. In optional embodiments, a top portion of second filter 214 positioned above the internal chamber 224 may define one or more openings 226 (e.g., vertical flow path openings), thereby permitting liquid to flow into the internal chamber 224 without passing through the first filter 212 or the fine filter media of the filter wall 220 of the second filter 214.

Between the top portion openings 226 and drain pump 168, internal chamber 224 may define an unfiltered volume, e.g., when liquid flows through the openings 226 into the internal chamber 224, the liquid is unfiltered in that the liquid did not flow through the filter media of the filter wall 220. A drain outlet 228 may be defined below the top portion openings 226 in fluid communication with internal chamber 224 and drain pump 168 (e.g., downstream of internal chamber 224 or upstream of drain pump 168).

During operation of some embodiments (e.g., during or as part of a wash cycle or rinse cycle), circulation pump 152 draws wash liquid in from sump 138 through filter assembly 210 (e.g., through first filter 212 or second filter 214). Thus, circulation pump 152 may be downstream of filter assembly 210.

Drainage of soiled wash liquid within sump 138 may occur, for instance, through drain assembly 166 (e.g., during or as part of a drain cycle). In particular, wash liquid may exit sump 138 through the drain outlet 228 and may flow through a drain conduit. In some embodiments, a drain pump 168 downstream of sump 138 facilitates drainage of the soiled wash liquid by urging or pumping the wash liquid to a drain line external to dishwasher 100. Drain pump 168 may be downstream of first filter 212 or second filter 214. Additionally or alternatively, an unfiltered flow path may be defined through sump 138 to drain conduit such that an unfiltered fluid flow may pass through sump 138 to drain conduit without first passing through filtration media of either first filter 212 or second filter 214.

For example, the unfiltered flow path may extend through the openings 226, whereby liquid may flow from a filter spillway 230 and into the internal chamber 224 from the top of the internal chamber 224, e.g., without passing through the wall 220 of the fine filter 214. Such unfiltered flow path may be available so long as a maximum height of liquid in the sump 138 is above the filter spillway 230, which may occur during a first portion of the drain cycle.

During, for example, a second portion of the drain cycle, when the maximum liquid height is below the filter spillway 230, e.g., at or below level "B" in FIG. 3, at least a portion of wash liquid within sump 138 may generally pass into internal chamber 224 through second filter 214, e.g., through filter wall 220, before flowing through drain assembly 166 and from dishwashing appliance 100. The second portion of the drain cycle may occur when the liquid level within the sump 138 has been drawn below the filter spillway 230, whereby liquid can no longer bypass the filter wall 200 of second filter 214 via the openings 226.

Although a separate recirculation pump 152 and drain pump 168 are described herein, it is understood that other suitable pump configurations (e.g., using only a single pump for both recirculation and draining) may be provided.

In certain embodiments, dishwasher 100 includes a controller 160 configured to regulate operation of dishwasher 100 (e.g., initiate one or more wash operations). Controller 160 may include one or more memory devices and one or more microprocessors, such as general or special purpose microprocessors operable to execute programming instructions or micro-control code associated with a wash operation that may include a wash cycle, rinse cycle, or drain cycle. The memory may represent random access memory such as DRAM, or read only memory such as ROM or FLASH. In some embodiments, the processor executes programming instructions stored in memory. The memory may be a separate component from the processor or may be included onboard within the processor. Alternatively, controller 160 may be constructed without using a microprocessor, e.g., using a combination of discrete analog or digital logic circuitry—such as switches, amplifiers, integrators, comparators, flip-flops, AND gates, and the like—to perform control functionality instead of relying upon software. It should be noted that controllers as disclosed herein are capable of and may be operable to perform any methods and associated method steps as disclosed herein.

Controller 160 may be positioned in a variety of locations throughout dishwasher 100. In optional embodiments, controller 160 is located within a control panel area 162 of door 116 (e.g., as shown in FIGS. 1 and 2). Input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of dishwasher 100. In some embodiments, user interface 164 includes a general purpose I/O ("GPIO") device or functional block. In additional or alternative embodiments, user interface 164 includes input components, such as one or more of a variety of electrical, mechanical or electromechanical input devices including rotary dials, push buttons, and touch pads. In further additional or alternative embodiments, user interface 164 includes a display component, such as a digital or analog display device designed to provide operational feedback to a user. When assembled, user interface 164 may be in operative communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For instance, different locations may be provided for user interface 164, different configurations may be provided for rack assemblies 122, 124, 126, different spray assemblies 134, 140, 142 and spray manifold configurations may be used, and other differences may be applied while remaining within the scope of the present disclosure.

Turning especially to FIG. 3, a close up, cross sectional view of sump 138 and a pressure sensor 200 is provided. In some instances, portions of dishwasher 100 may become obstructed or clogged, such as at filter assembly 210. Accordingly, and in accordance with exemplary aspects of the present disclosure, dishwasher 100 utilizes outputs from pressure sensor 200 to monitor or prevent obstructions or clogs.

In some embodiments, pressure sensor 200 may be mounted to sump 138, e.g., as illustrated in FIG. 2. For instance, pressure sensor 200 may be mounted upstream of internal chamber 224 and second filter 214. Additionally or alternatively, pressure sensor 200 may be mounted downstream of first filter 212.

Pressure sensor 200 is operatively configured to detect a liquid level within sump 138 and communicate the liquid level to controller 160 (FIG. 2) via one or more signals. Thus, pressure sensor 200 and controller 160 are generally provided in operative communication.

During use, pressure sensor 200 may transmit signals to controller 160 for instance, as a frequency, as an analog signal, or in another suitable manner or form that can be received by controller 160 to detect a pressure value, e.g., as a value of relative pressure or hydrostatic pressure, such as value in units of $mmH_2O$. In certain embodiments, pressure sensor 200 is configured to sense the height of the wash liquid above pressure sensor 200 along the vertical direction V (e.g., by detecting the pressure on pressure sensor 200).

In some embodiments, pressure sensor 200 includes a pressure plate that is generally acted on by the pressure of the wash liquid within sump 138. As the liquid level rises, the pressure plate is pushed upward along the vertical direction V and, thus, compresses air trapped within the housing and a diaphragm of pressure sensor 200. Compression may cause the diaphragm to flex or alter its position. As a result of the pressure and consequent movement of the diaphragm, a permanent magnet attached to the diaphragm may change its position in relation to a Hall-effect transducer. The transducer delivers one or more electrical signals proportional to the magnetic field of the magnet. Optionally, the signals from pressure sensor 200 may be linearized, digitized, or amplified before being sent to controller 160 for processing. Additionally or alternatively, the pressure sensor 200 may include a printed circuit board (PCB) board to electrically connect the various electrical components of pressure sensor 200. Moreover, pressure sensor 200 can be any suitable type of sensor capable of sensing the liquid level within dishwasher 100.

Figure 4:
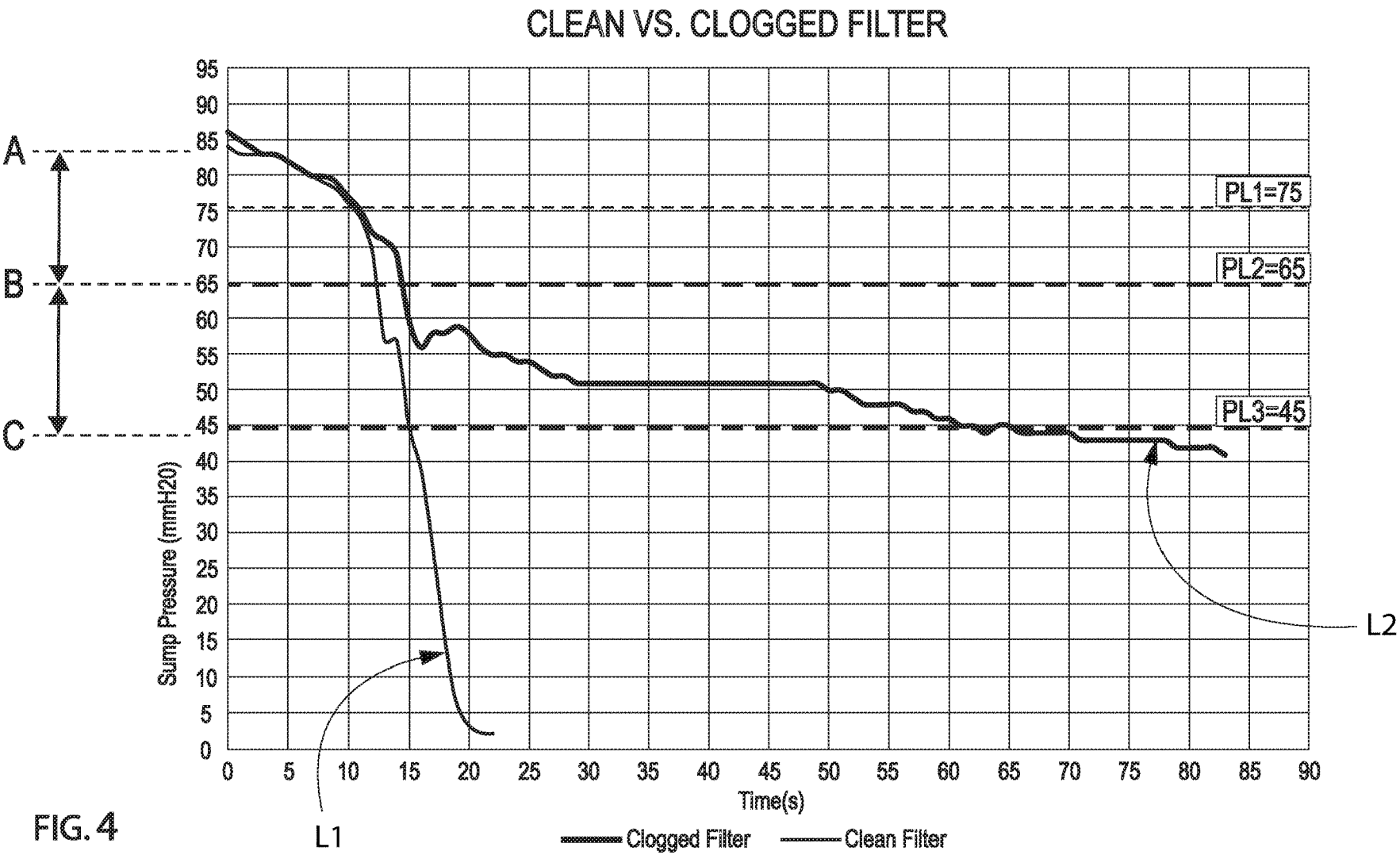
FIG. 4 provides a chart illustrating detected pressure over time during exemplary dishwashing operations.

Turning now to FIG. 4, a chart is provided illustrating pressure values (e.g., detected at pressure sensor 200) over a period of time. Specifically, FIG. 4 illustrates two discrete instances of operation of an exemplary dishwasher (e.g., dishwasher 100, as shown in FIG. 1) during a drain cycle. As indicated in the legend of FIG. 4, the thin line L1 depicts pressure during operation of the exemplary dishwasher during a drain cycle wherein the filter is generally clean or otherwise free of obstructions/clogs, whereas the bold line L2 depicts pressure during operation of an exemplary dishwasher 100 that contains includes a dirty or obstructed filter.

As may be seen in FIG. 4, when the liquid level in the sump 138 is above the filter spillway 230, e.g., above level "B," the rate of change in the sump pressure is about the same for a clean filter (L1) or a clogged filter (L2). However, it may also be seen from FIG. 4 that once the liquid level falls below the filter spillway 230, e.g., between level "B" and level "C," such that the liquid can no longer bypass the filter wall 220 of fine filter 214 via the openings 226, the rate of change in the sump pressure for a clean filter (L1) is more easily distinguished from the rate of change in the sump pressure for a clogged filter (L2). As may be generally seen in FIG. 4, in either instance, the rate of change in the sump pressure changes over time as the liquid level in the sump decreases. For example, the change in the rate of pressure change may be due in part to the geometry of the sump, e.g., a varying diameter of the sump. Where the diameter of the sump varies and the pressure sensor only measures or responds to the vertical height of liquid in the sump, even with a perfectly constant flow rate (volume over time), the rate of change of pressure in the sump will vary due to the varying proportions of the sump. However, the degree or extent of change in the rate of change in sump pressure as the liquid level crosses the spillway threshold will vary from one instance to the next based on the filter state. Thus, by comparing the rate of pressure change during drainage of liquid from level A to level B with the rate of pressure change during drainage of liquid from level B to level C within the same drain cycle, a filter status may be determined, e.g., a clogged or fouled filter may be identified.

Additionally, such comparison of slopes or rates of change, e.g., from A to B compared to from B to C, may also advantageously eliminate or reduce the effect of background factors, such as installation conditions, on the filter state detection process. For example, if the rate of change in the sump pressure is compared to a fixed or absolute threshold, false positives may result, e.g., if the dishwashing appliance is installed into or connected with a plumbing system having a clog or obstruction in the plumbing system downstream of the dishwashing appliance, the rate of change in the sump pressure may be slow, and such slow draining may be falsely interpreted as indicating a clogged filter if the rate of change in the sump pressure is compared to a fixed or absolute threshold. Thus, comparing an initial slope and a subsequent slope of the same instance of operating the dishwashing appliance, such as the slope of line L1 from A to B and from B to C in FIG. 4, or the slope of line L2 from A to B and from B to C in FIG. 4, may advantageously factor out drain conditions other than the filter state and thereby avoid false positives and unnecessary consumption of water and time to clean a filter that is not actually fouled.

Figure 5:
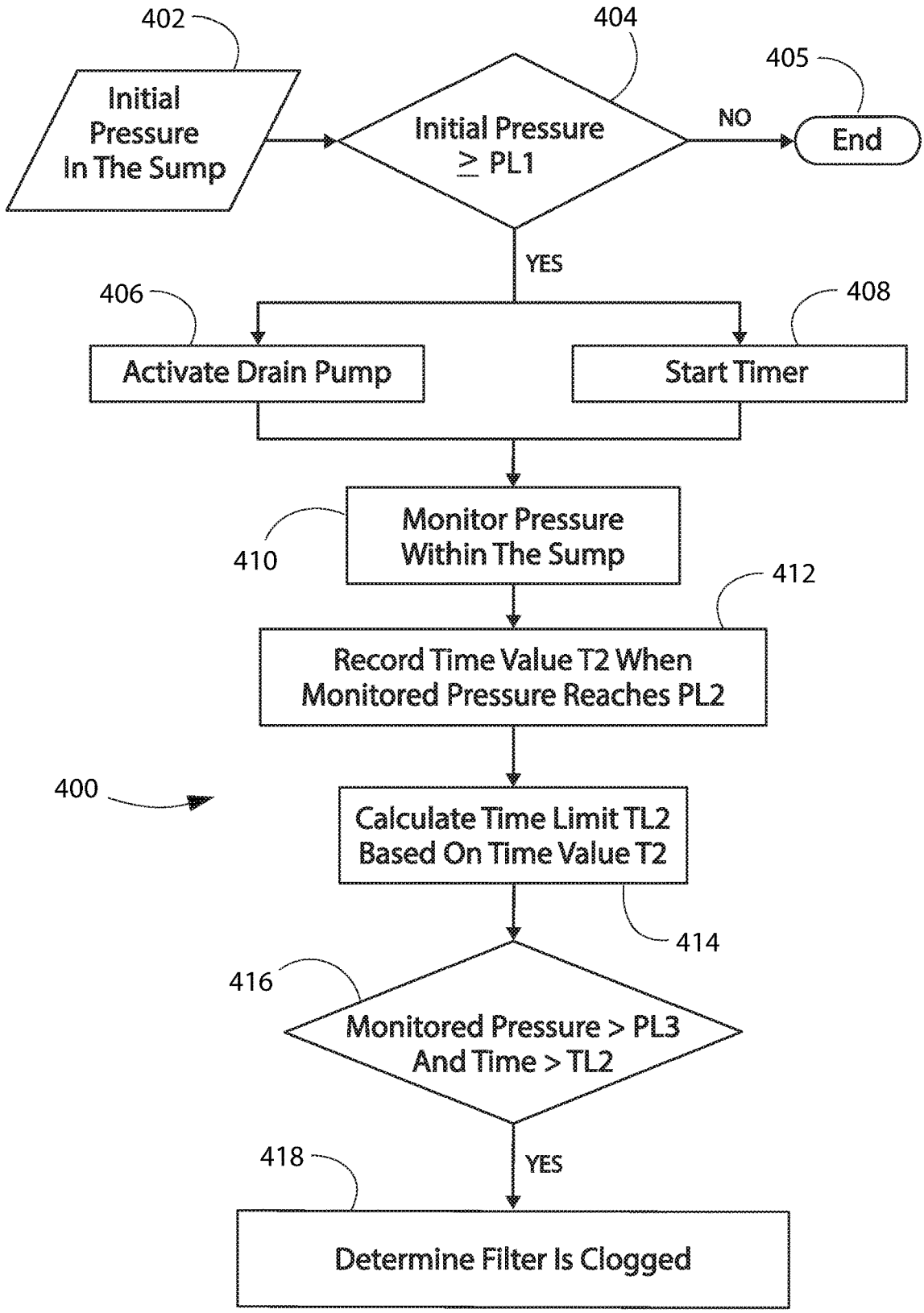
FIG. 5 provides a flow chart of a method of operating a dishwashing appliance according to one or more exemplary embodiments of the present disclosure.

Turning now to FIG. 5, an example method 400 for operating a dishwashing appliance is illustrated. Method 400 may be used to operate any suitable dishwashing appliance. As an example, some or all of the steps in method 400 may be used to operate dishwashing appliance 100 (FIG. 1). The controller 160 (FIG. 2) may be programmed to implement some or all of the steps in method 400 (e.g., as or as part of a wash operation, such as at a drain cycle).

In certain embodiments, method 400 follows (e.g., occurs subsequent to) a portion of a wash cycle or rinse cycle. For instance, method 400 may occur after a volume of wash liquid has been supplied to wash chamber. The wash chamber and/or sump may thus be filled with a volume of wash liquid at the start of method 400.

The method 400 may include, at step 402, receiving or measuring an initial pressure in the sump. For example, the initial pressure may be measured with a pressure sensor and/or a signal with the measured initial pressure embedded or encoded therein may be received by the controller from the pressure sensor. The initial pressure may be an initial pressure or first, beginning, pressure of a drain cycle. Thus, for example, the initial pressure may follow a preceding cycle such as a wash cycle or a rinse cycle. In some embodiments, the method 400 may therefore include waiting for a stabilization time to elapse prior to measuring the initial pressure. For example, the stabilization time may allow pressure within the sump to stabilize after the wash cycle or rinse cycle where liquid may continue to drain into the sump after the wash cycle or rinse cycle is completed, e.g., after liquid is no longer actively being sprayed into the wash chamber there may still be some residence time for liquid in the wash chamber before the liquid reaches the sump. Thus, the sump pressure may continue to change even after the wash cycle or rinse cycle has ended due to continued drainage of residual liquid from the wash chamber to the sump. Accordingly, the stabilization time may permit the liquid level and/or pressure within the sump to become static after the spraying during the preceding cycle has stopped. The stabilization time may be between about one second and about ten seconds, such as between about two seconds and about six seconds, such as about three seconds.

As illustrated in FIG. 5, the method may also include a step 404 of comparing the initial pressure to a first pressure threshold PL1. For example, the method 400 may include determining whether the initial pressure is greater than or equal to the first pressure threshold PL1. The first pressure threshold PL1 may correspond to a height of liquid or liquid level that is at the level of the filter spillway 230, e.g., at or about level B as illustrated in FIGS. 3 and 4. Thus, in such embodiments, if the initial pressure is greater than or equal to the first pressure threshold PL1, then it may be determined that liquid is able to reach the drain outlet 228 without necessarily flowing through the fine filter, e.g., at least a portion of liquid drained from the wash chamber to the sump may travel through the openings 226 rather than through the filter wall 220 of the fine filter 214, as described above.

If the initial pressure is less than the first pressure threshold PL1, e.g., the starting height of the liquid at the beginning of the drain cycle is below the spillway 230, then the drain cycle will not include the deflection or inflection described above with respect to FIG. 4, e.g., when the liquid level crosses the spillway threshold and the rate of change of pressure in the sump changes. Accordingly, in such instances when the determination at step 404 is no, the method 400 may end at 405. In various embodiments, ending the method 400 at step 405 may include not draining the sump or may include draining the sump without detecting filter status.

When the determination at step 404 is yes, e.g., when the initial pressure is greater than or equal to the first pressure threshold PL1, the method 400 may then proceed to steps 406 and 408. As illustrated in FIG. 5, at 406, the method 400 includes activating the drain pump. For instance, the drain pump may actively urge or motivate a fluid flow when activated. At 408, the method 400 includes starting a timer when the drain pump is activated.

After activating the drain pump at 406 and starting the time at 408, the method 400 may then continue to step 410 of monitoring the pressure within the sump while the drain pump is operating and the timer is running. When the monitored pressure reaches a second pressure threshold PL2 at 412 in FIG. 5, the method 400 may then include recording a value of the timer as a first time value T2. In some embodiments, the method 400 may also include comparing the timer to a time threshold while monitoring the pressure at 410 and, if the monitored pressure does not reach the second pressure threshold PL2 before the timer reaches the time threshold, the method 400 may continue to a standard drain algorithm without filter status detection.

As illustrated in FIG. 5, the method 400 may also include a step 414 of calculating a time limit TL2 based on the recorded first time value T2. In some embodiments, the time limit TL2 may also be based on the measured initial pressure, e.g., the time limit TL2 may be a function of the first time value T2 and the measured initial pressure. For example, the time limit TL2 may be based on a difference between the measured initial pressure and the first pressure threshold, e.g., may be based on how far above the spillway the liquid level was when the drain cycle initiated.

After step 414, the drain pump may continue to operate and the timer may continue to run during the method 400. Moreover, the method 400 may include continuing to monitor or measure the pressure in the sump. Accordingly, as illustrated at 416 in FIG. 5, the method 400 may include a step 416 of comparing the monitored pressure to a third pressure threshold PL3 and comparing the time to the time limit TL2. When the pressure does not reach the third pressure threshold PL3 until after the time limit TL2, a clogged filter may be detected. For example, as shown at 416 and 418 in FIG. 5, the method may include determining whether the pressure is greater than the third pressure threshold PL3 and the time is greater than the time limit TL2 at 416 and when both are true, e.g., when 416 leads to yes in FIG. 5, the method 400 may then include determining that the filter is clogged at 418.

In further additional or alternative embodiments, in response to a dirty condition, e.g., in response to determining that the filter is clogged, one or more exemplary methods may include initiating a user alert (e.g., cleaning alert) at a user interface of the dishwashing appliance. Thus, initiating a user alert may be, at least in part, in response to a determination that the monitored pressure did not reach the third pressure threshold PL3 before the time limit TL2 expired. The user alert may include an audio or visual alert. Thus, a user may be advantageously informed that the filter is in need of or requires cleaning. As an example, a speaker may be directed to generate an audible sound wave corresponding to the determined dirty condition. As another example, a controller may direct a light source or display of the user interface to transmit a visual identifier corresponding to the determined dirty condition.

In some embodiments, e.g., when the dishwashing appliance includes filter cleaning features such as the filter clean spray assembly 145, exemplary methods of the present disclosure may include activating a filter clean mode in response to determining that the filter is clogged. Additionally, such embodiments may further include incrementing a counter, such as a clean counter and/or a drain cycle counter, after activating the filter clean mode. For example, such embodiments may then include initiating a user alert at a user interface of the dishwashing appliance when the clean counter is greater than a clean count limit and/or when the drain cycle count is greater than a cycle count limit. For example, the user alert may be initiated when the clean count exceeds the clean count limit as an absolute limit and/or may be initiated when the clean count exceeds a clean count limit per a certain number of drain cycles.

Certain embodiments of the present disclosure may also or instead include providing more detailed information about the filter status, such as a percent fouled. For example, exemplary methods may include recording a second value of the timer as a second time when the monitored pressure reaches the third pressure threshold. In such embodiments, a percent fouling status of the filter may be calculated based on the first time and the second time and the calculated percent fouling status of the filter may be displayed on a user interface of the dishwashing appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a dishwashing appliance comprising a sump, a pressure sensor mounted within the sump, a filter downstream from the pressure sensor, and a drain pump downstream from the pressure sensor, the method comprising:

measuring an initial pressure in the sump with the pressure sensor;

activating the drain pump when the measured initial pressure in the sump is greater than or equal to a first pressure threshold;

starting a timer when the drain pump is activated;

monitoring pressure within the sump with the pressure sensor after activating the drain pump;

recording a value of the timer as a first time when the monitored pressure reaches a second pressure threshold;

calculating a time limit based on the recorded first time value; and determining that the filter is clogged when the monitored pressure does not reach a third pressure threshold before the time limit expires.

2. The method of claim 1, wherein the time limit is based on the measured initial pressure.

3. The method of claim 1, wherein the time limit is based on a difference between the measured initial pressure and the first pressure threshold.

4. The method of claim 1, further comprising initiating a user alert at a user interface of the dishwashing appliance in response to determining that the filter is clogged.

5. The method of claim 1, further comprising activating a filter clean mode in response to determining that the filter is clogged.

6. The method of claim 5, further comprising incrementing a counter after activating the filter clean mode and initiating a user alert at a user interface of the dishwashing appliance when the counter is greater than a count limit.

7. The method of claim 5, further comprising incrementing a clean counter after activating the filter clean mode and initiating a user alert at a user interface of the dishwashing appliance when the clean counter is greater than a clean count limit.

8. The method of claim 1, further comprising performing a wash cycle or rinse cycle prior to measuring the initial pressure, and waiting for a stabilization time to elapse after the wash cycle or rinse cycle is completed and prior to measuring the initial pressure.

9. The method of claim 1, further comprising recording a second value of the timer as a second time when the monitored pressure reaches the third pressure threshold, calculating a percent fouling status of the filter based on the first time and the second time, and displaying the calculated percent fouling status of the filter on a user interface of the dishwashing appliance.

10. A dishwashing appliance, comprising:

a cabinet;

a tub positioned within the cabinet and defining a wash chamber for receipt of articles for washing;

a spray assembly positioned within the wash chamber;

a sump positioned at a bottom of the wash chamber;

a drain pump in fluid communication with the sump;

a pressure sensor upstream of the drain pump;

a filter downstream from the pressure sensor; and a controller in operative communication with the pressure sensor and the drain pump, the controller being configured for:

measuring an initial pressure in the sump with the pressure sensor;

activating the drain pump when the measured initial pressure in the sump is greater than or equal to a first pressure threshold;

starting a timer when the drain pump is activated;

monitoring pressure within the sump with the pressure sensor after activating the drain pump;

recording a value of the timer as a first time when the monitored pressure reaches a second pressure threshold;

calculating a time limit based on the recorded first time value; and determining that the filter is clogged when the monitored pressure does not reach a third pressure threshold before the time limit expires.

11. The dishwashing appliance of claim 10, wherein the time threshold is based on the measured initial pressure.

12. The dishwashing appliance of claim 10, wherein the time threshold is based on a difference between the measured initial pressure and the first pressure threshold.

13. The dishwashing appliance of claim 10, wherein the controller is further configured for initiating a user alert at a user interface of the dishwashing appliance in response to determining that the filter is clogged.

14. The dishwashing appliance of claim 10, wherein the controller is further configured for activating a filter clean mode in response to determining that the filter is clogged.

15. The dishwashing appliance of claim 14, wherein the controller is further configured for incrementing a counter after activating the filter clean mode and initiating a user alert at a user interface of the dishwashing appliance when the counter is greater than a count limit.

16. The dishwashing appliance of claim 14, wherein the controller is further configured for incrementing a clean counter after activating the filter clean mode and initiating a user alert at a user interface of the dishwashing appliance when the clean counter is greater than a clean count limit.

17. The dishwashing appliance of claim 10, wherein the controller is further configured for performing a wash cycle or rinse cycle prior to measuring the initial pressure, and waiting for a stabilization time to elapse after the wash cycle or rinse cycle is completed and prior to measuring the initial pressure.

18. The dishwashing appliance of claim 10, wherein the controller is further configured for recording a second value of the timer as a second time when the monitored pressure reaches the third pressure threshold, calculating a percent fouling status of the filter based on the first time and the second time, and displaying the calculated percent fouling status of the filter on a user interface of the dishwashing appliance.

* * * * *